US007547135B2

(12) United States Patent
Kocienski

(10) Patent No.: US 7,547,135 B2
(45) Date of Patent: Jun. 16, 2009

(54) DISPOSABLE SANITARY MIXING APPARATUS AND METHOD

(75) Inventor: Anthony C. Kocienski, Rochester, NY (US)

(73) Assignee: SPX Corporation, Charlotte, NC (US)

( * ) Notice: Subject to any disclaimer, the term of this patent is extended or adjusted under 35 U.S.C. 154(b) by 586 days.

(21) Appl. No.: 11/219,738

(22) Filed: Sep. 7, 2005

(65) Prior Publication Data

US 2007/0053238 A1 Mar. 8, 2007

(51) Int. Cl.
*B01F 13/08* (2006.01)

(52) U.S. Cl. ..... 366/273

(58) Field of Classification Search ..... 366/273, 366/274; 435/302.1
See application file for complete search history.

(56) References Cited

U.S. PATENT DOCUMENTS 1,123,092 A * 12/1914 Calvert ..... 261/24
2,711,306 A * 6/1955 Levi ..... 366/273
2,958,517 A * 11/1960 Harker et al. ..... 435/302.1
2,996,363 A * 8/1961 Ruyak ..... 422/226
3,362,692 A * 1/1968 Iannone et al. ..... 366/274
3,494,597 A * 2/1970 Rosinger ..... 366/142
3,580,812 A * 5/1971 Bender et al. ..... 435/302.1
4,247,792 A * 1/1981 Klicks et al. ..... 310/104
5,044,762 A 9/1991 Blakley et al.
5,480,228 A 1/1996 Gambrill et al.
5,568,985 A 10/1996 Schutte
6,132,080 A 10/2000 Gurth
6,670,171 B2 12/2003 Carll
2002/0145940 A1* 10/2002 Terentiev ..... 366/273
2002/0163855 A1 11/2002 Beebe
2003/0227817 A1 12/2003 Martel et al.

OTHER PUBLICATIONS

Notification of Transmittal of the International Search Report and the Written Opinion of the International Searching Authority, or the Declaration, issued by the U.S. Patent and Trademark Office on Apr. 6, 2007 (the International Search Report is on p. 3 of the Notification).

* cited by examiner

*Primary Examiner*—David L Sorkin
(74) *Attorney, Agent, or Firm*—Baker & Hostetler LLP

(57) ABSTRACT

A mixing apparatus and method uses a disposable assembly including a closed vessel with a rotating shaft supported in the vessel. The shaft has radially extending impellers. The shaft is driven via an external magnetic drive system. The vessel can be cleaned during manufacture and discarded after use.

16 Claims, 4 Drawing Sheets

DISPOSABLE SANITARY MIXING APPARATUS AND METHOD

FIELD OF THE INVENTION

The invention pertains generally to mixing devices, and more particularly pertains to mixing devices having a closed mixing vessel and rotating shaft impellers.

BACKGROUND OF THE INVENTION

Rotating impeller type mixing devices are in wide use in industry. For example, there are many types of mixing devices that generally utilize a mixing vessel to hold the fluid and/or other mixing material, which is to be mixed or agitated. The vessels can be of any suitable shape, including for example cylindrical, oval, square, etc. A motor driven impeller shaft extends into the vessel and has paddle type impellers radially extending therefrom so that when the shaft is rotated the impellers agitate and/or mix the material inside the vessel.

In some applications, such as particularly sanitary applications including, for example, pharmaceutical or food operations, it is generally desirable for the mixing device to be cleaned into a highly sterile condition before the material is added, and to be sealed during the mixing operation so that the material does not become contaminated. This concern is particularly heightened in the case of biological mixing reactions in the pharmaceutical and biotechnology industries.

A frequently used type of known mixing device has a vessel and some form of closure seal attachment via which the mixing shaft projects into the vessel. In order to clean this type of device thoroughly enough for some applications, it is necessary to dismantle the seal and undergo a time consuming and laborious cleaning process. It is common for seals to be cleaned in-situ by SIP (steam in place) and/or CIP (clean in place, flush with acid & caustic solutions). Further, this cleaning process generally needs to be carried out at the site location where the mixing device is located, requiring additional steam or chemical cleaning equipment to be present at that site. Further, at the actual mixing site it may be difficult for the operators to know if they have satisfactorily performed the cleaning.

Accordingly, there is a need in the art for a mixing apparatus and method that can provide a highly clean or sterile internal environment at a mixing site, while also being convenient and practical to use.

SUMMARY OF THE INVENTION

Some embodiments of the invention provide a mixing apparatus and method that can provide a highly clean or sterile internal environment at a mixing site, while also being convenient and practical to use.

In accordance with one embodiment of the present invention, a mixing apparatus, comprises an enclosed vessel having an input/output port and a rotating impeller system mounted for rotation inside the vessel, and a drive system completely external to the vessel and configured to drive the impeller shaft from outside the vessel.

In accordance with another embodiment of the present invention, a mixing apparatus, comprises an enclosed vessel having an input/output port and a rotating impeller system mounted for rotation inside the vessel, and driving means completely external to the vessel for driving the impeller shaft from outside the vessel.

In accordance with another embodiment of the present invention, a mixing method, comprises providing an enclosed vessel having an input/output port and a rotating impeller system mounted for rotation inside the vessel, and driving the rotating shaft impeller using a drive system completely external to the vessel and configured to drive the impeller shaft from outside the vessel.

In accordance with yet another embodiment of the present invention, a method of mixing a material, comprises providing a completely sealed vessel having an impeller mounted inside for rotation and completely sealed inside the vessel, adding a material to be mixed inside the vessel, and driving the impeller shaft via a drive system disposed completely outside the vessel to mix the material.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
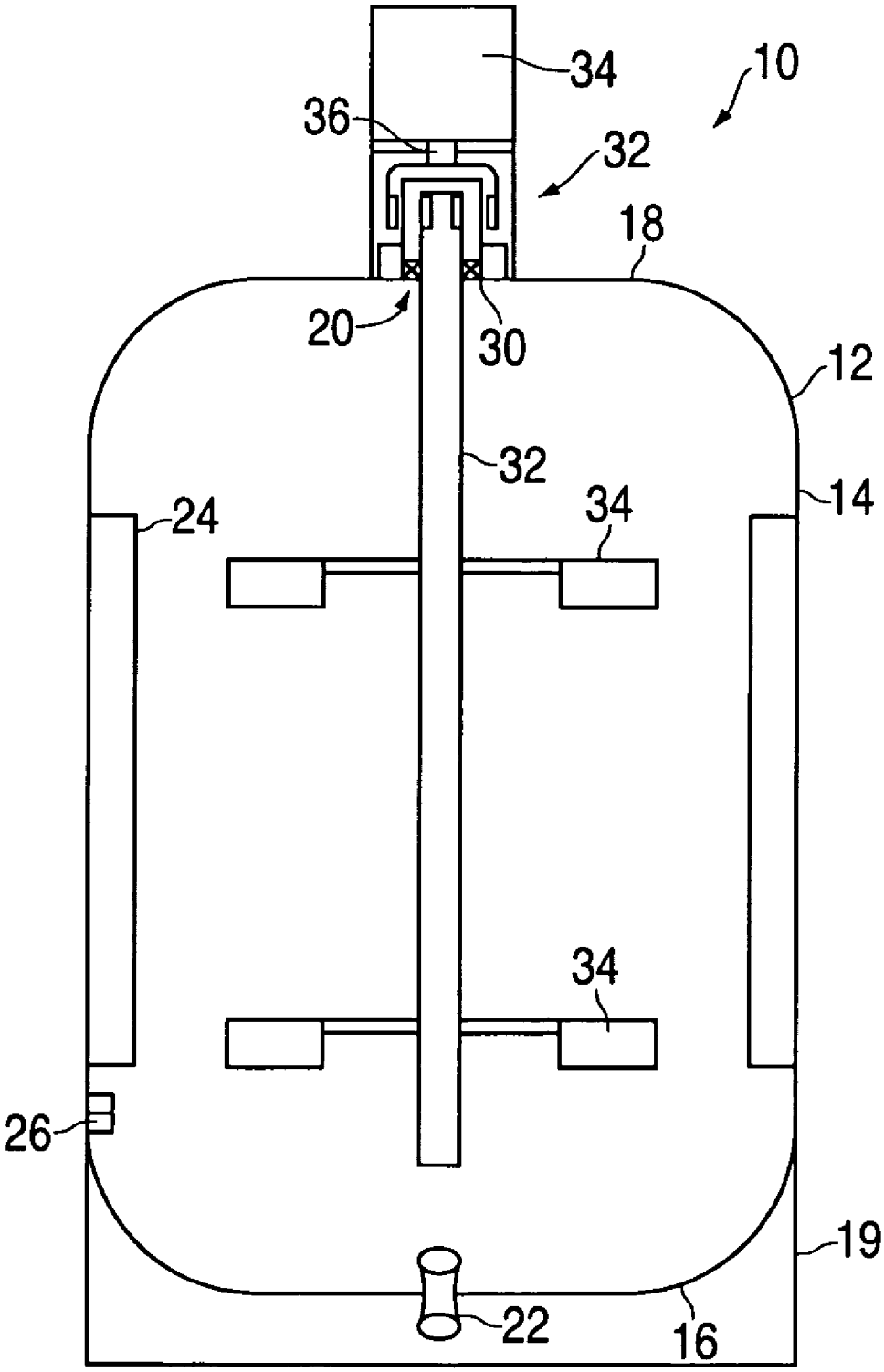
FIG. 1 is a side cut-away layout view of a mixing apparatus according to a preferred embodiment of the invention.

Some embodiments of the invention provide a mixing apparatus and method that can provide a highly clean or sterile internal environment at a mixing site, while also being convenient and practical to use. Preferred embodiments of the invention will now be described with reference to the drawing figures in which like reference numerals refer to like parts throughout.

FIG. 1 illustrates a mixing apparatus 10, which includes a vessel 12, which is generally cylindrical with two closed ends. The vessel 12 thus has a cylindrical side wall 14 a lower end 16 and an upper end 18. The vessel 12 also has a dome 20 associated therewith as will be described in more detail below. The vessel 14 may also include a molded in base or set of feet 19. The vessel 12, including its sidewall 14 and ends 16 and 18, can be made of any suitable material, but in some instances it is preferable that it be molded from a plastic material.

As is described in more detail below, one benefit of some embodiments of the invention is that the vessel 12 can be made disposable. In such instances, the vessel can be sterilized at the place of manufacture, than can be transported to the location where it is utilized for mixing. During such transport the inside of the vessel 12 remains sterile and thus at the site of use for mixing there is no need to sterilize the vessel 12 before use. Rather, the vessel 12 can simply be filled with the material to be mixed via a sanitary input/output valve 22, and after mixing has occurred and the vessel 12 is emptied, again via the input/output valve 22, the vessel 12 can be disposed of and a different vessel 12 used the next time. The sterile input/output valve 22 is of a type known in the art.

The vessel 12 maybe provided with a plurality of inwardly radial-protruding baffles 24 spaced around the internal circumference of the vessel wall 14. The baffles 24 may be separate components or may be molded in the same molding process as that used to mold the vessel 12. The vessel 12 may also have attached thereto or molded therein one or more different types of sensor elements 26 as are known in the art. The sensor elements may include temperature, pressure, and/or oxygen sensors for the appropriate application.

A dome 20, which is a separately manufactured piece that is attached to the molded plastic vessel 12, is mounted to the vessel 12 to close what would otherwise be an opening 30 at the top of the vessel 12. The dome 20 surrounds bearings and other structure which will be described in other detail below in order to support an impeller shaft 32 which has radially extending therefrom a suitable number of impellers 34. A magnetic drive system 32 as will be discussed in more detail below is provided so that the impeller shaft 32 can be driven from or externally provided motor and control system 34. The motor and control system 34 includes a motor driving a drive shaft 36 and may also include control elements that interact with the sensor(s) 26. Alternatively, the sensor(s) 26 may interface with other diagnostic or control equipment (not shown).

Figure 2:
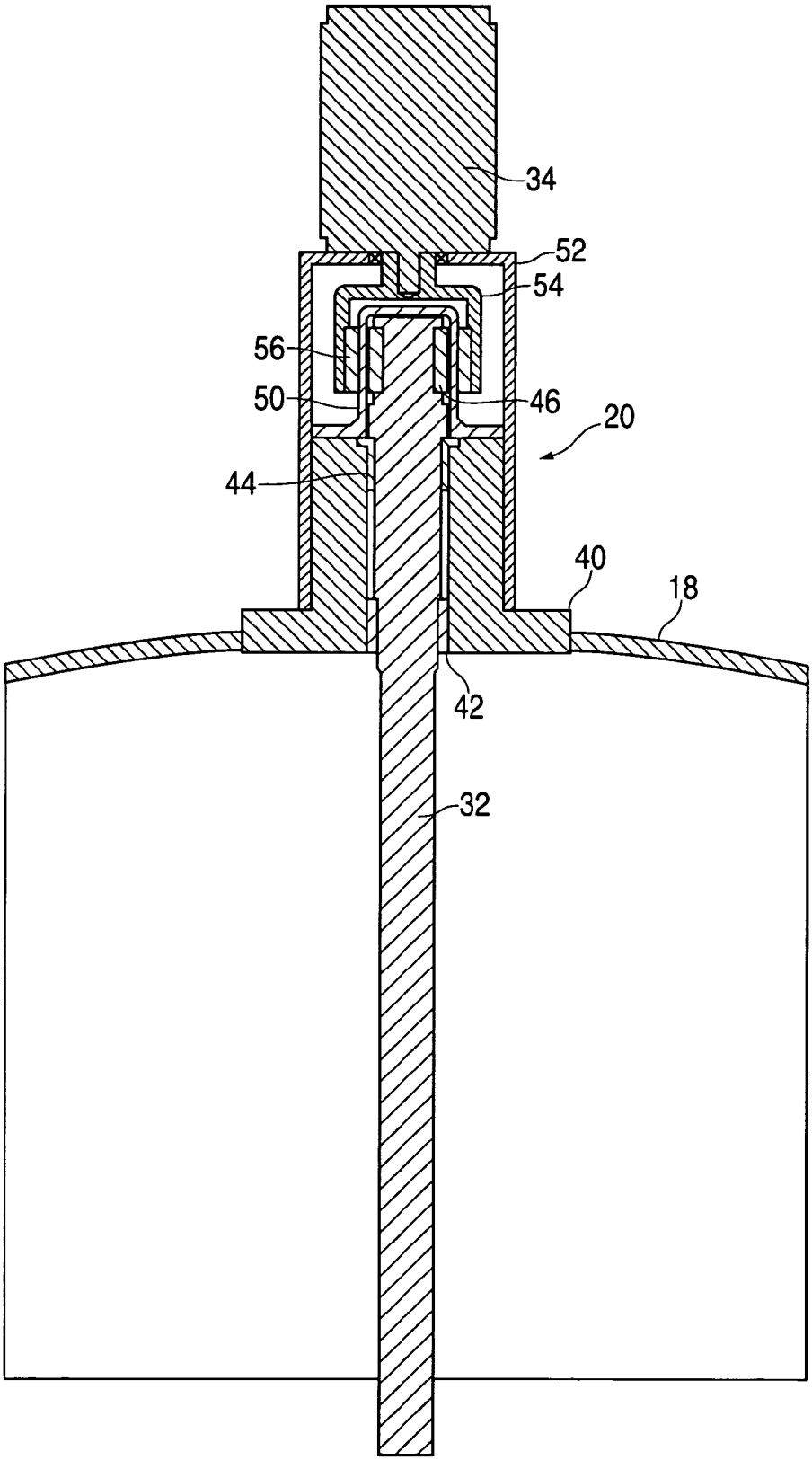
FIG. 2 is a detailed cross-sectional view of the top of the apparatus of FIG. 1.

The upper portion of the apparatus 10 is shown in more detail in FIG. 2. In FIG. 2, it can be seen that the dome 20 includes a fitting 40 that is attached to the top end of the molded vessel 18. The fitting 40 may be attached by being ultrasonically welded, by adhesive or other attachment means. The fitting 40 may be of any suitable material, including plastic or metal. The fitting 40 supports lower bearings 42 and upper bearings 44, which support the impeller shaft 32 for rotation. These bearings 42 and 44 may be any suitable type of bearing including metal bearings or plastic bearings, but since they may come in contact with the fluid to be mixed are preferable selected to be dry running bearings.

At the top of the shaft 32 a plurality of impeller shaft magnets 46 are provided to face outwardly from the shaft. The magnets 46 may sit within respective grooves or channels and can be counter-sunk into the top of the shaft 32. Since these magnets may also come in contact with some of the material being mixed, the region of the impeller shaft 32 having the magnets 46 may be coated with any suitable coating material, and the magnets 46 can be made flush with the circumference of the shaft 32 or may project outwardly some. The top of the impeller shaft 32 including the magnets 46 sits inside of the dome 20 that is mounted to the top of the fitting 40. Thus, the top of the shaft 32 can spin freely inside of the dome 20. It will be appreciated that the top wall 18, fitting 40, and dome 20 together provide an enclosure to enclose the material being mixed and protect it from any contamination.

The motor and control system 34 can be mounted onto the mixing assembly 10 via a bayonet bracket 52 that slides onto the outer surface of the fitting 40. The bayonet bracket 52 has bearings that support a drive rotor 54 that is rotationally driven by the motor and has rotor magnets 56 inwardly facing from the drive rotor 54. The rotor magnets 56 are spaced outwardly from the dome 20 and are not in contact therewith, but are sufficient to create a magnetic field so that rotation of the rotor 54 magnetically drives the shaft 32 via magnetic coupling of the rotor magnets 56 with the shaft magnets 46.

Figure 3:
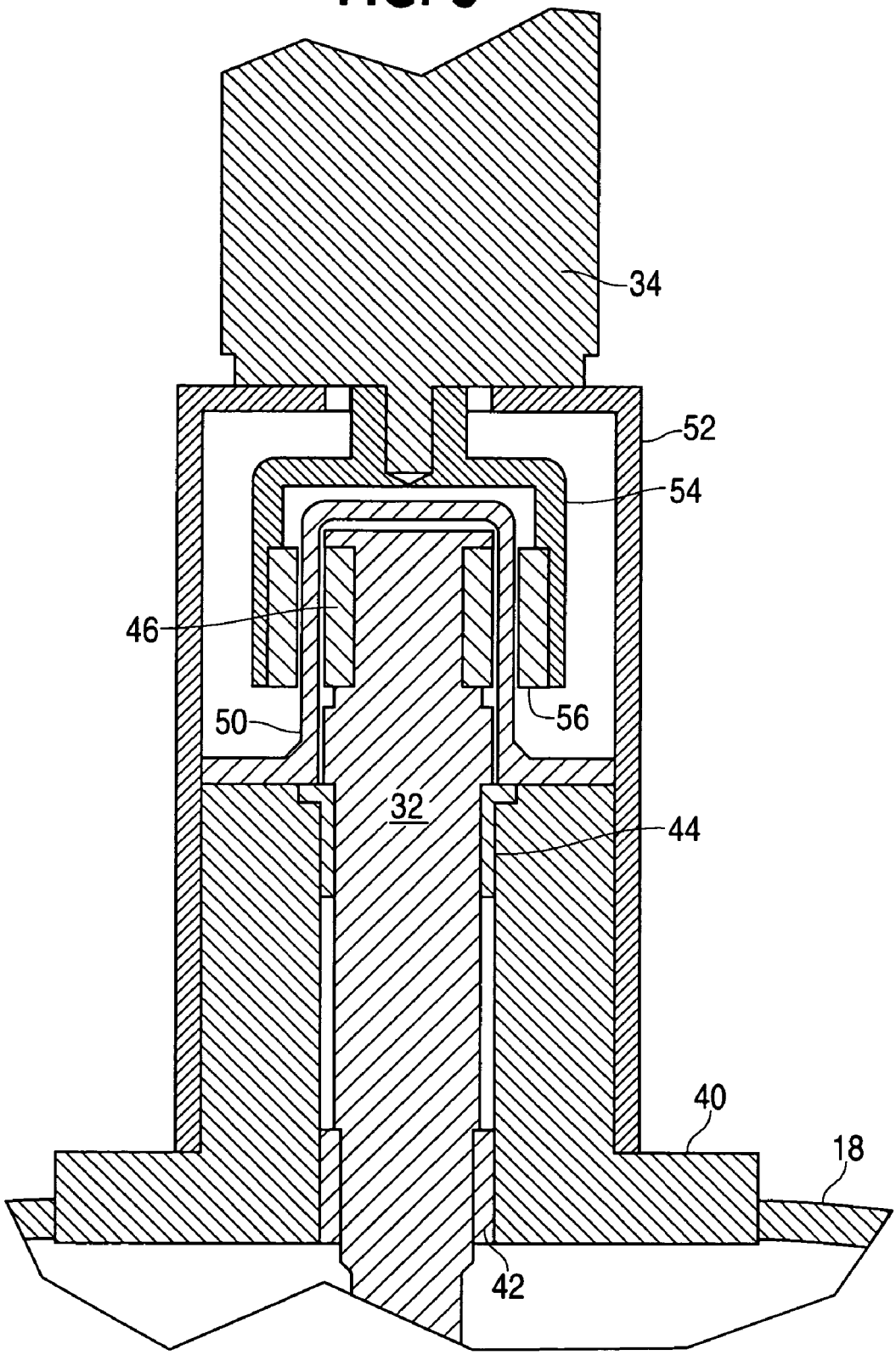
FIG. 3 is a further magnified detailed view of the top of the apparatus shown in FIG. 1.
Figure 4:
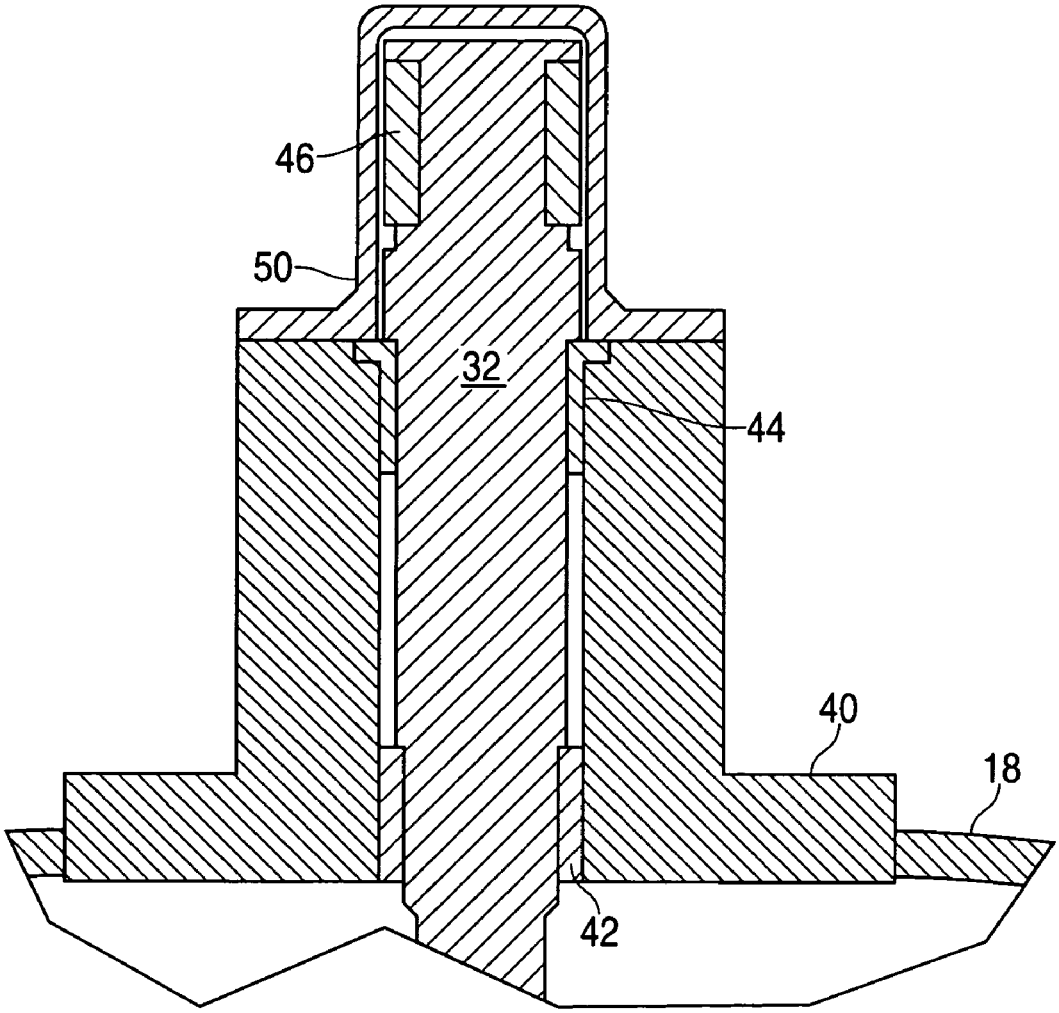
FIG. 4 is a view corresponding to FIG. 3, but illustrating the apparatus with a motor drive system removed from the top thereof.

FIG. 3 shows these components in more detail, and FIG. 4 illustrates the top of the vessel, the fitting, and the dome with the motor drive assembly removed. The operation of the apparatus will now be described in further detail.

In one preferred method of utilizing the mixing device 10, a disposable mixing enclosure is manufactured by molding or otherwise forming or assembling the vessel 14, including baffles 24 and/or sensors 26 as desired, and ultrasonically welding or otherwise attaching to an opening at the top of the vessel 14 a closure including for example a fitting 40 and a dome 20. The fixture 40 and/or dome 20 together enclose the top of the vessel, and also provide rotational support for an impeller shaft 32 as well as magnets 46 for magnetic driving of the impeller shaft 32 via a driver rotor 54 disposed outside the dome 20. Once manufactured, this enclosed arrangement can be cleaned to any desired degree via steam and/or chemical sterilization applied through a sterile input/out fitting 22 located somewhere in the vessel 14. Or all the parts can be cleaned before assembly, and then assembled and attached into the final configuration for example in a clean room.

Once this sterile apparatus 10 has been through the sterilization process, the fitting 22 can be closed and now the vessel 12 will remain heretically sealed during transport to the mixing site location. At the mixing site location, the vessel 12 can be filled through the sterile input/output valve 22, and after filling the valve 22 can be closed and a mixing process can be performed. If the vessel 12 has sensors 26, the sensors 26 are connected to communicate with an external control mechanism, and the magnetic motor drive arrangement 34 is installed over top of the dome 20 to drive the impeller shaft 32. Mixing can then be performed as desired. Subsequent to the mixing process, the vessel 12 can be emptied via the input/output port 22, and thereafter can be disposed of, or if desired can be put through a cleaning cycle for reuse.

In some embodiments, the entire assembly 10 including the vessel 12, dome 20, impeller shaft 32, and fitting 40 as well as bearings 42 and 44 can be sold as a sterile unit, and after mixing this entire assembly can be discarded. The motor and control system 34 can be a fairly permanent reusable arrangement.

Various embodiments of the invention provide certain advantages and flexibility in design and application. For example, where it is anticipated that the entire vessel and impeller shaft system will be disposed of after one use, or only a few uses, then impeller shaft bearings can be selected which will be expected to undergo one or only a few cycles and these bearings may be less expensive than bearings that are designed for a longer useful life having more cycles. Further, since the vessels can be made interchangeable with a single drive and central system, it is possible for a mixing location site to have a single drive and control system and yet be able to interchange different sizes or other types of vessels. Thus, the vessel and its impeller can be selected for certain applications and easily interchanged. Also, even if the vessels are to be cleaned on site or returned to a facility for cleaning, down time is reduced because almost immediately after a vessel is removed, a new vessel can be put into service using the same drive and control system. Another benefit of disposable embodiments is that after the material has been mixed and removed, the input/output valve 22 can be closed and any biologically sensitive material is retailed or heretically sealed inside the vessel. The vessel can be transported to a disposal location where, via incineration or other method, the biologically sensitive material will be safely disposed of. This may be a desirable way of handling biologically sensitive material as compared to trying to clean out a permanent reusable mixer.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A mixing apparatus, comprising:

an enclosed vessel having an input/output port and a rotating impeller system mounted for rotation inside the vessel, wherein the vessel comprises:

a molded plastic body having an inlet/outlet port proximate a bottom end thereof, and an opening at a top end thereof;

a fixture mounted to the opening;

a pair of dry-running bearings supported by the fixture;

an impeller shaft wherein the impeller shaft is supported by the pair of dry-running bearings;

magnets mounted to an end of the impeller shaft which is supported by the bearings;

a dome mounted to the fixture and enclosing the end of the impeller shaft and the bearings, so that an enclosed envelope is provided by the vessel, fixture, and the dome; and a removable drive system completely external to the vessel and configured to drive the impeller shaft from outside the vessel, wherein the drive system is adapted to slide onto and over the fitting, and wherein the drive system has magnets that interact with the magnets on the shaft.

2. The apparatus of claim 1, wherein the vessel further comprises radially inwardly extending baffles.

3. The apparatus of claim 1, wherein vessel further comprises instrumentation mounted inside the vessel.

4. The apparatus of claim 1, wherein the fixture and dome are attached to the vessel by ultrasonic welding.

5. The apparatus of claim 1, wherein the fitting is configured as a bayonet, and the drive system is configured to slide over the fitting.

6. A mixing apparatus, comprising:

an enclosed vessel having an input/output port and a rotating impeller system mounted for rotation inside the vessel; and a removable driving means completely external to the vessel for driving the impeller shaft from outside the vessel, wherein the vessel comprises:

a molded plastic body having an inlet/outlet port proximate a bottom end thereof, and an opening at a top end thereof;

a fixture mounted to the opening;

a pair of dry-running bearings supported by the fixture;

an impeller shaft wherein the impeller shaft is supported by the pair of dry-running bearings;

magnets mounted to an end of the impeller shaft which is supported by the bearings;

a dome mounted to the fixture and enclosing the end of the impeller shaft and the bearings, so that an enclosed envelope is provided by the vessel, fixture, and the dome; and a removable drive system completely external to the vessel and configured to drive the impeller shaft from outside the vessel; wherein the drive system is adapted to slide onto and over the fitting, and wherein the drive system has magnets that interact with the magnets on the shaft.

7. The apparatus of claim 6, wherein the vessel further comprises radially inwardly extending baffles.

8. The apparatus of claim 6, wherein vessel further comprises instrumentation mounted inside the vessel.

9. The apparatus of claim 6, wherein the fixture and dome are attached to the vessel by ultrasonic welding.

10. The apparatus of claim 6, wherein the fitting is configured as a bayonet, and the drive system is configured to slide over the fitting.

11. A mixing method, comprising:

providing an enclosed vessel having an input/output port and a rotating impeller system mounted for rotation inside the vessel, wherein the vessel comprises:

a molded plastic body having an inlet/outlet port proximate a bottom end thereof, and an opening at a top end thereof;

a fixture mounted to the opening;

a pair of dry-running bearings supported by the fixture;

an impeller shaft wherein the impeller shaft is supported by the pair of dry-running bearings;

magnets mounted to an end of the impeller shaft which is supported by the bearings;

a dome mounted to the fixture and enclosing the end of the impeller shaft and the bearings, so that an enclosed envelope is provided by the vessel, fixture, and the dome; and driving the rotating shaft impeller using a removable drive system completely external to the vessel and configured to drive the impeller shaft from outside the vessel, wherein the drive system is adapted to slide onto and over the fitting, and wherein the drive system has magnets that interact with the magnets on the shaft.

12. The method of claim 11, wherein the vessel further comprises radially inwardly extending baffles.

13. The method of claim 11, wherein vessel further comprises instrumentation mounted inside the vessel.

14. A method of mixing a material, comprising:

providing a completely sealed vessel having an impeller mounted inside for rotation and completely sealed inside the vessel, wherein the vessel comprises:

a molded plastic body having an inlet/outlet port proximate a bottom end thereof, and an opening at a top end thereof;

a fixture mounted to the opening;

a pair of dry-running bearings supported by the fixture;

an impeller shaft wherein the impeller shaft is supported by the pair of dry-running bearings;

magnets mounted to an end of the impeller shaft which is supported by the bearings;

a dome mounted to the fixture and enclosing the end of the impeller shaft and the bearings, so that an enclosed envelope is provided by the vessel, fixture, and the dome; and adding a material to be mixed inside the vessel; and driving the impeller shaft via a removable drive system disposed completely outside the vessel to mix the material, wherein the drive system is adapted to slide onto and over the fitting, and wherein the drive system has magnets that interact with the magnets on the shaft.

15. The method of claim 14, further comprising the step of sterilizing the vessel prior to adding the material.

16. The method of claim 14, further comprising the step of discarding of the vessel after mixing.

* * * * *